US009682819B2

(12) United States Patent
Reeb

(10) Patent No.: US 9,682,819 B2
(45) Date of Patent: Jun. 20, 2017

(54) CONTAINER WITH AUTOMATIC LATCH ASSEMBLY

(71) Applicant: SERIO-US INDUSTRIES, INC., Baltimore, MD (US)

(72) Inventor: David L. Reeb, Sykesville, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 215 days.

(21) Appl. No.: 14/165,252

(22) Filed: Jan. 27, 2014

(65) Prior Publication Data

US 2014/0208813 A1 Jul. 31, 2014

Related U.S. Application Data

(60) Provisional application No. 61/756,861, filed on Jan. 25, 2013.

(51) Int. Cl.
*E05C 1/06* (2006.01)
*B65F 1/16* (2006.01)
*E05B 47/00* (2006.01)

(52) U.S. Cl.
CPC ..... *B65F 1/1615* (2013.01); *E05B 47/00* (2013.01); *B65F 2210/108* (2013.01); *B65F 2210/168* (2013.01); *E05B 2047/0058* (2013.01); *E05B 2047/0086* (2013.01); *E05B 2047/0088* (2013.01); *Y10T 70/7062* (2015.04)

(58) Field of Classification Search
CPC ..... B65F 2210/108; G08B 13/1427; G08B 21/0269; B65D 2203/10; B65D 43/162; B65D 2251/1058; B65D 43/16; E05B 2047/0096; E05B 2047/0094
USPC ..... 292/144, DIG. 11, DIG. 12; 220/244, 220/263, 315, 323, 545.6, 572.9
See application file for complete search history.

(56) References Cited

U.S. PATENT DOCUMENTS 4,591,835 A * 5/1986 Sharp ..... 340/574
4,691,840 A 9/1987 Ferbrache
(Continued)

FOREIGN PATENT DOCUMENTS

DE 4405547 8/1995
DE 4428427 2/1996
(Continued)

*Primary Examiner* — Mark Williams
(74) *Attorney, Agent, or Firm* — Berenato & White, LLC

(57) ABSTRACT

A container comprises a hollow body portion, a hinged lid member pivotally attached to the body portion, an automatic latch assembly fixed to the body portion or the lid member, and a locking strap provided with an engagement member. The latch assembly comprises a casing and a lock bolt reciprocating between locked and unlocked positions. The lock bolt engages the engagement member of the locking strap in the locked position and is disengaged from the engagement member in the unlocked position. The latch assembly further comprises an actuator for moving the lock bolt out of engagement with the engagement member, a signal receiver for receiving a wireless signal or an accelerometer for monitoring acceleration of the container, and an electronic control module electrically connected to the signal receiver or the accelerometer for controlling the operation of the actuator in response to the wireless signal or data from the accelerometer.

25 Claims, 15 Drawing Sheets

(56) References Cited

U.S. PATENT DOCUMENTS

| | | | | |
|---|---|---|---|---|
| 5,153,561 | A * | 10/1992 | Johnson | 340/571 |
| 5,224,744 | A | 7/1993 | Michelutti | |
| 5,385,258 | A | 1/1995 | Sutherlin | |
| 5,392,025 | A | 2/1995 | Figh et al. | |
| 5,630,631 | A | 5/1997 | Iwamoto et al. | |
| 5,638,977 | A | 6/1997 | Bianchi | |
| 6,116,067 | A * | 9/2000 | Myers et al. | 70/279.1 |
| 6,133,842 | A * | 10/2000 | Gariepy | 340/689 |
| 6,374,649 | B1 | 4/2002 | Holcomb et al. | |
| 6,902,080 | B2 | 6/2005 | Busch | |
| 6,902,081 | B2 | 6/2005 | Walker | |
| 6,967,575 | B1 | 11/2005 | Dohrmann et al. | |
| 7,277,009 | B2 * | 10/2007 | Hall et al. | 340/539.22 |
| 7,735,884 | B2 | 6/2010 | Bacco et al. | |
| 2002/0014488 | A1 | 2/2002 | Schermel | |
| 2003/0155366 | A1 | 8/2003 | Raghunathan | |
| 2006/0169696 | A1 | 8/2006 | Taylor | |
| 2007/0090114 | A1 | 4/2007 | Rouns | |
| 2007/0175910 | A1 | 8/2007 | Hogarth et al. | |
| 2008/0191867 | A1 * | 8/2008 | Markovich | 340/539.13 |
| 2009/0078702 | A1 | 3/2009 | Martin, Jr. et al. | |
| 2011/0210135 | A1 | 9/2011 | Huff et al. | |
| 2012/0012588 | A1 | 1/2012 | Shield et al. | |

FOREIGN PATENT DOCUMENTS

| | | | |
|---|---|---|---|
| DE | 102010054658 | | 7/2012 |
| DE | 102010054658 | A1 * | 7/2012 |
| GB | 2416564 | | 2/2006 |
| WO | 2010082878 | | 7/2010 |
| WO | 2011070603 | | 6/2011 |

* cited by examiner 22
220
230
230a
232
234
236
238
239
240
244
247
250
253
255
258
260
262
268
284

22
24
220
230
230a
230a
232
234
236
237
238
239
240
241
244
247
250
253
255
260
262
284
231
85
85
85
85

22
230
220
230a
268
244
247
232
238
239
236
240
265
253
250
262
234
284
260
262
230a

CONTAINER WITH AUTOMATIC LATCH ASSEMBLY

CROSS-REFERENCE TO RELATED APPLICATIONS

This application claims the benefit of priority of provisional application 61/756,861 filed on Jan. 25, 2012 by David L. Reeb, which is hereby incorporated herein by reference in its entirety and to which priority is claimed.

BACKGROUND OF THE INVENTION

1. Field of the Invention

This invention relates generally to containers and, more particularly, to a container for receiving waste or recyclable material provided with an automatic latch assembly for securing and locking closed a lid of the container. The automatic latch assembly prevents unauthorized access of the container while still allowing access from a refuse company to empty the container without a driver manually unlocking the latch assembly and while still allowing the container owner to access the container through a lock.

2. Description of the Related Art

Currently, residential trash containers are used to store accumulated household refuse until such household refuse can be collected by garbage trucks or the like. Typically, such refuse containers include a lid for concealing the household refuse collected therein, as well as to prevent wild animals or people from accessing the household refuse and also protecting the trash from the elements. With some containers, the lid is integrally mounted to a storage bin which contains the collected household refuse. Such containers, however, are awkward to use. Specifically, the trash container can be knocked over by wind, animals or people and spill the trash. Automatic latch assemblies with gravity activated mechanisms have been developed to allow dumping of containers without manually unlocking the latch assembly, yet still keeping the container locked at all other times. The gravity activated latch assemblies can be simply unlocked by tipping the container forward, therefore defeating the purpose of the lock.

The present invention overcomes this inherent design flaw by keeping container locked in any position or angle, even upside down until the refuse company dumps the container or the customer opens it.

The latch assembly according to the present invention is mounted on the outside of the container keeping it free from contamination and damage from waste while also providing a visual deterrent.

SUMMARY OF THE INVENTION

The present invention provides a residential waste container comprising a hollow body portion having a closed bottom and an open top, a hinged lid member pivotally attached to the body portion so as to be selectively movable between an open position to access the container and a closed position to close the open top thereof and restrict access to the container, an automatic latch assembly fixed to the body portion or the lid member, and a locking strap having a first end portion fixed to the lid member or the body portion, and a second end portion disposed opposite to the first end portion and provided with an engagement member.

The automatic latch assembly comprises a casing defining an internal cavity therein and fixed to one of the body portion and the lid member, a lock bolt reciprocating between a locked position preventing an opening of the lid member of the container and an unlocked position allowing the opening of the lid member. The lock bolt engages the engagement member of the second end portion of the locking strap in the locked position, while in the unlocked position, the lock bolt is disengaged from the engagement member of the second end portion of the locking strap.

The latch assembly further comprises an actuator secured within the internal cavity of the casing for moving the lock bolt out of engagement with the engagement member, a signal receiver for receiving a wireless signal or an accelerometer for monitoring acceleration of the container, and an electronic control module electrically connected to the signal receiver or the accelerometer for controlling the operation of the actuator in response to the wireless signal or data from the accelerometer.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
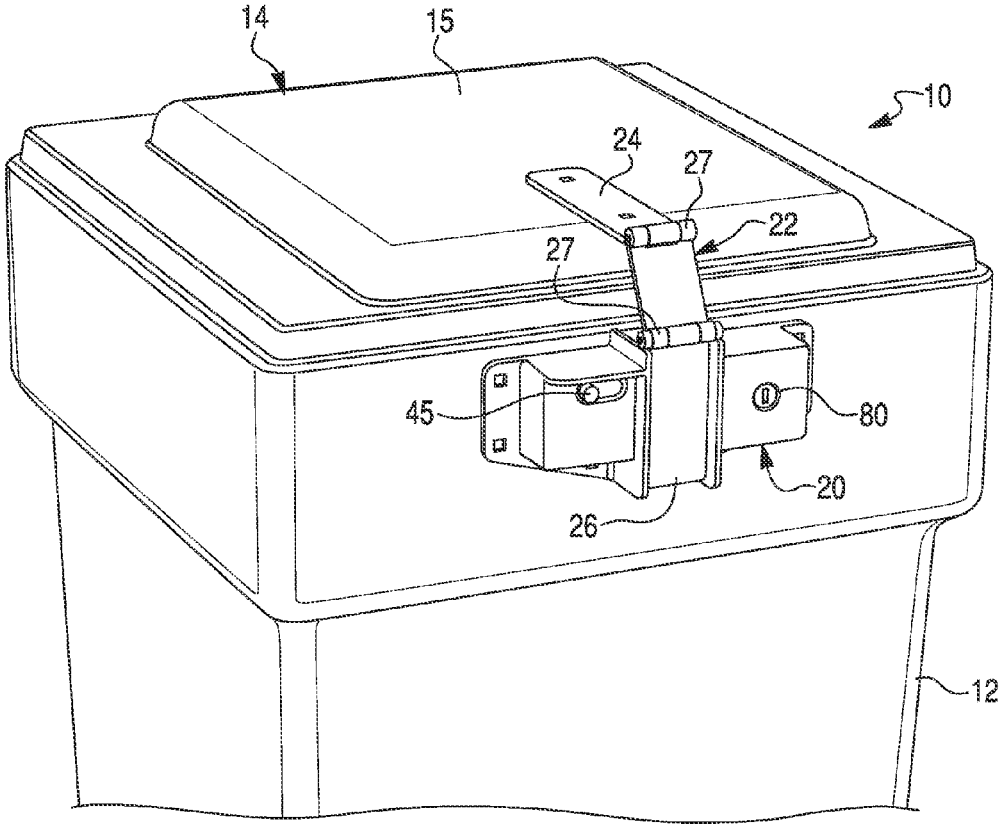
FIG. 1 is a perspective view of a residential trash container according to a first exemplary embodiment of the present invention.

The exemplary embodiment(s) of the present invention will now be described with the reference to the accompanying drawings.

For purposes of the following description, certain terminology is used in the following description for convenience only and is not limiting. The words such as "front" and "rear", "left" and "right", "upper" and "lower", "uppermost" and "lowermost", "inwardly" and "outwardly" designate directions in the drawings to which reference is made. The words "smaller" and "larger" refer to relative size of elements of the apparatus of the present invention and designated portions thereof. The terminology includes the words specifically mentioned above, derivatives thereof and words of similar import. Additionally, the word "a", as used in the claims, means "at least one".

FIG. 1 illustrates a residential trash or recycling container 10 according to a first exemplary embodiment of the present invention that comprises a hollow body portion 12 and a lid member 14 that is pivotally attached to a rear side of the body portion 12 by a hinge. The hollow body portion 12 has a closed bottom and an open top edge to which the lid member 14 fits. The lid member 14 can be manipulated between an open position to access the residential trash container 10 and a closed position closing the top edge and restricting access to the residential trash container 10. The residential trash container 10 may be generally rectangular or cylindrical in shape, however the shape may be dictated by methods of manufacture, economics or aesthetics. It will be appreciated that any other containers with removable or pivotable lids, such as dumpsters, are within the scope of the present invention.

As further illustrated in FIG. 1, the residential trash container 10 comprises an automatic latch assembly 20 fixedly (i.e., non-movably) attached to the body portion 12 adjacent to the lid member 14, and an elongated locking strap 22 removably and lockingly connecting the lid member 14 to the body portion 12 of the residential trash container 10 through the latch assembly 20. More specifically, the locking strap 22 has a first end portion 24 fixed to a top surface 15 of the lid member 14, and a second end portion 26 opposite to the first end portion 24. The first end portion 24 of the locking strap 22 is fixed to the top surface 15 of the lid member 14 by any appropriate means known in the art, such as by bolts, screws, rivets and the like fasteners extending through openings 25 (best shown in FIG. 2) in the first end portion 24 of the locking strap 22 or by adhesive bonding. The second end portion 26 of the locking strap 22 is detachably connected to the latch assembly 20. Also, the first end portion 24 and the second end portion 26 of the locking strap 22 are pivotably connected to each other via at least one, possibly two hinge joints 27. Alternatively, the latch assembly 20 can be fixedly attached to the lid member 14 adjacent to the body portion 12, while the first end portion 24 of the locking strap 22 is fixed to the body portion 12.

Figure 2:
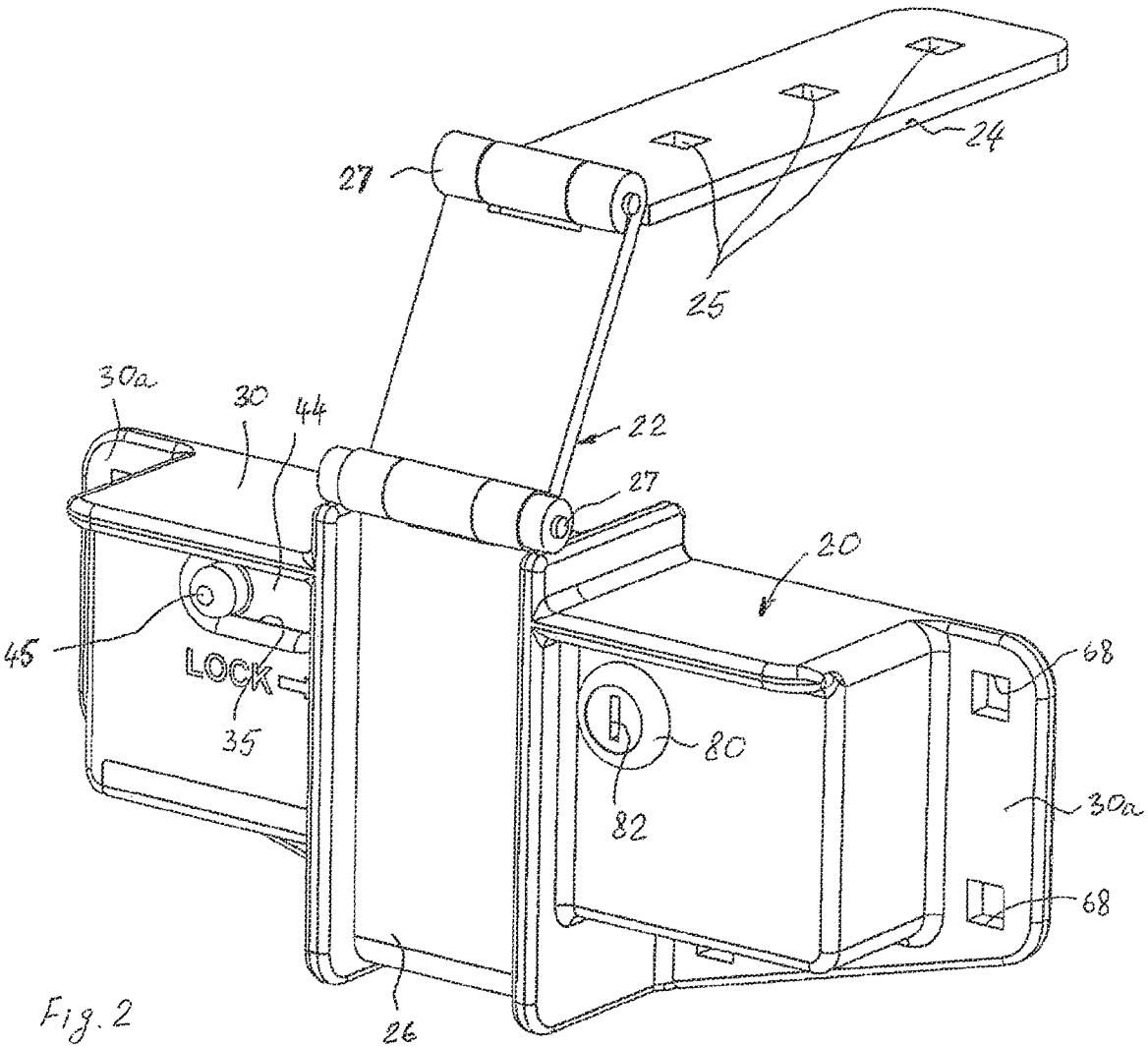
FIG. 2 is a perspective view of an automatic latch assembly according to the first exemplary embodiment of the present invention in a locked position.
Figure 3:
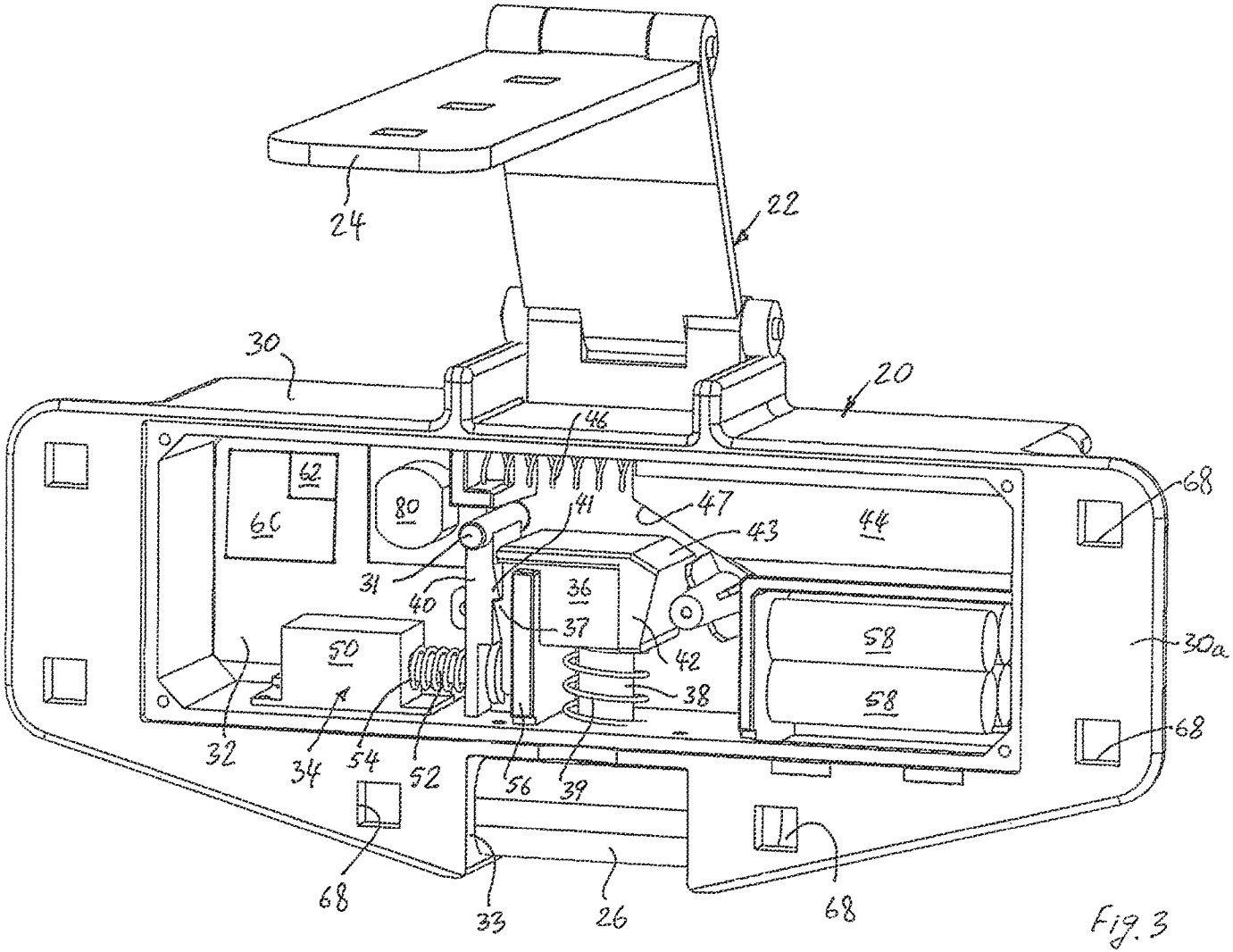
FIG. 3 is a perspective view showing components of the latch assembly according to the first exemplary embodiment of the present invention in the locked position.
Figure 4:
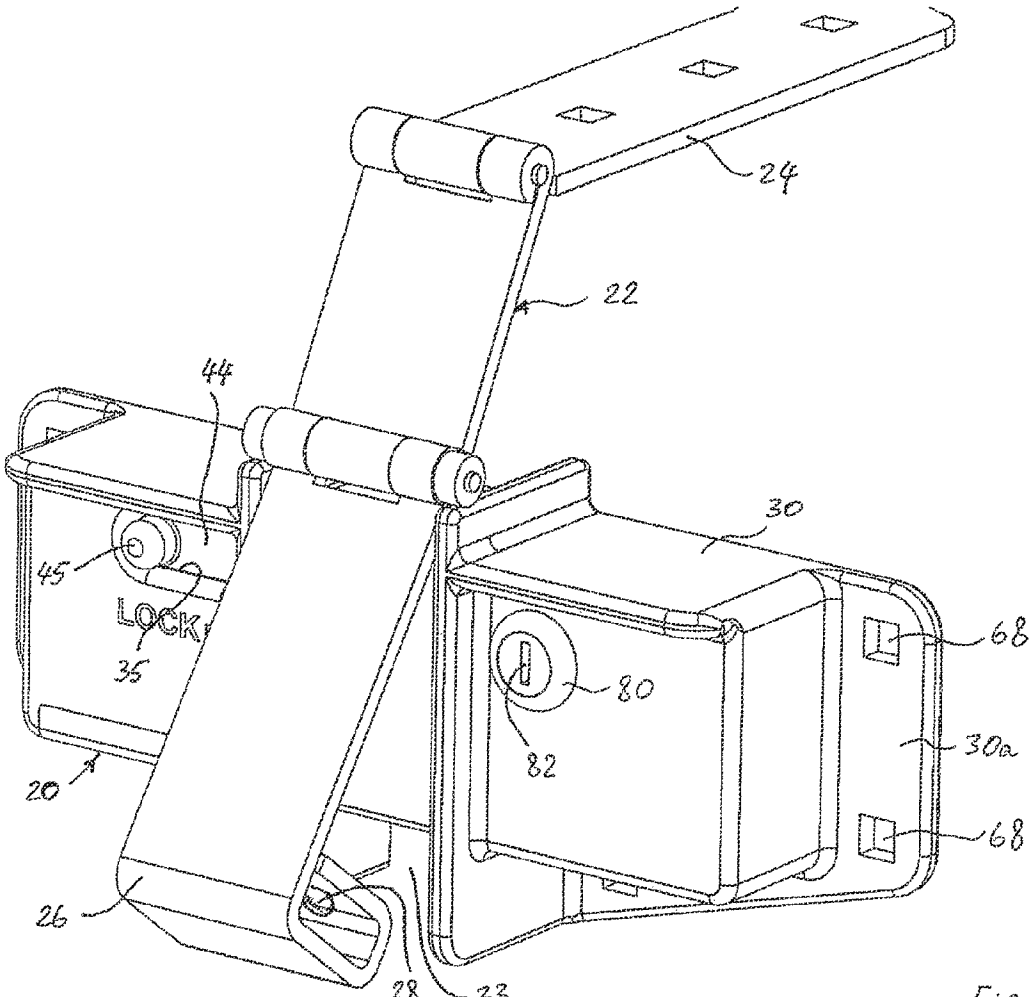
FIG. 4 is a perspective view of the latch assembly according to the first exemplary embodiment of the present invention in an unlocked position.
Figure 5:
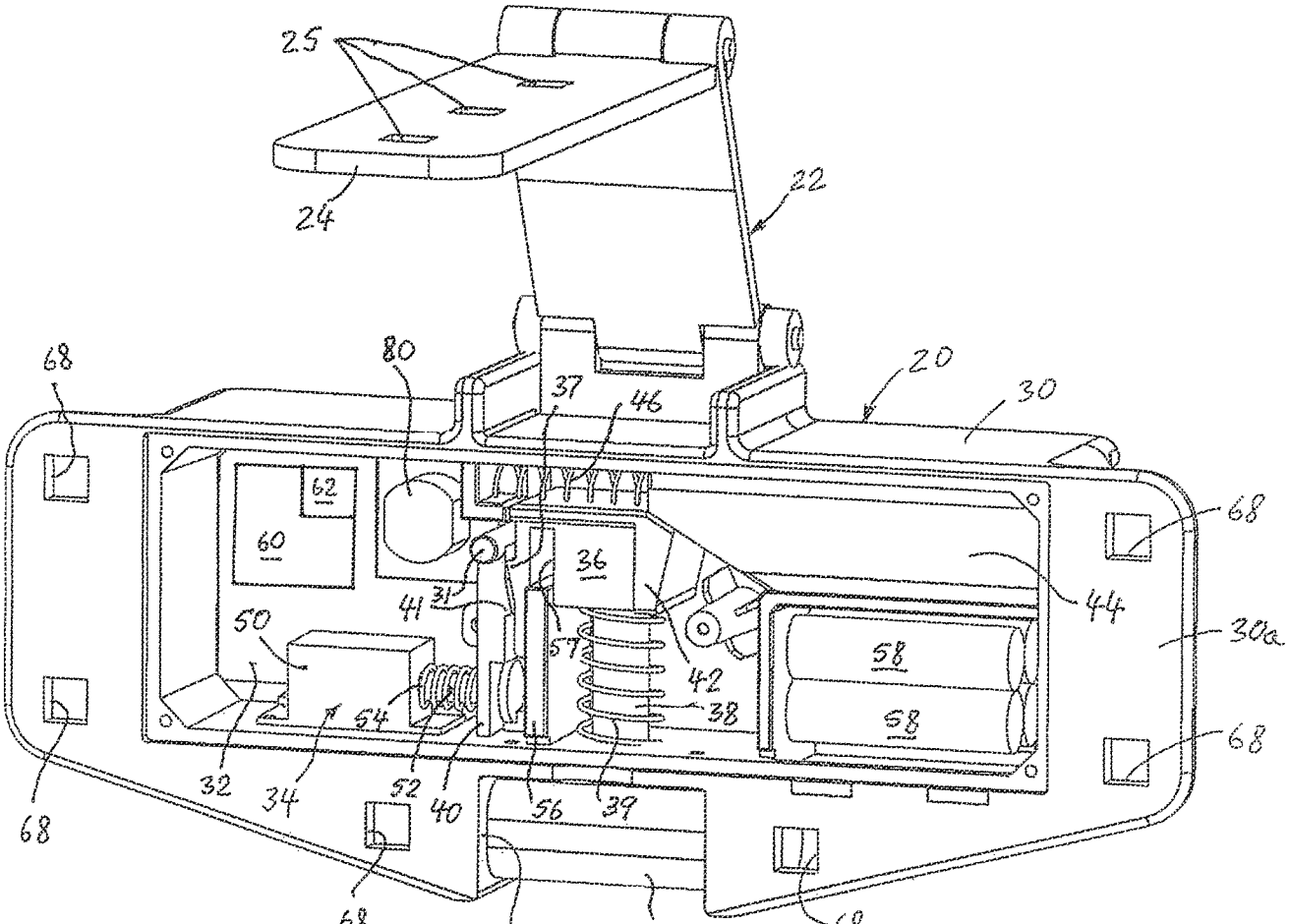
FIG. 5 is a perspective view showing the components of the latch assembly according to the first exemplary embodiment of the present invention in the unlocked position.

The latch assembly 20 can be manipulated between a locked position preventing opening of the lid member 14 of the container 10 and an unlocked position allowing opening of the lid member 14. The latch assembly 20 according to the first exemplary embodiment of the present invention comprises a casing 30 fixed (i.e., non-movably secured) to the body portion 12 of the container 10 and defining an internal cavity 32 therein (as best shown in FIG. 3), an electromagnetic actuator, such as a solenoid actuator 34, a lock member 36 non-movably attached to a lock bolt 38 for linear reciprocating displacement therewith in the substantially vertical direction, a latch member (or trigger) 40 mounted to the casing 30 and pivotably movable relative to the reciprocating lock member 36, an arming portion 42 integrally, non-movably attached to the lock member 36, and an arming member 44 reciprocating in the direction substantially perpendicular to the reciprocating direction of the lock member 36. In other words, as best illustrated in FIGS. 3 and 5, if the lock member 36 reciprocates in the substantially vertical direction, then the arming member 44 reciprocates in the substantially horizontal direction. The arming member 44 is spring biased to a position away from the arming portion 42 by a spring member 46, shown in the form of a coil spring 46. The arming member 44 includes a knob 45 integrally formed therewith. As shown in FIGS. 2 and 4, the knob 45 of the arming member 44 extends from the internal cavity 32 of the casing 30 through an elongated, substantially horizontal opening 35 in the casing 30. The knob 45 is provided for manually moving the arming member 44 by the user in the direction against the biasing force of the spring member 46.

The lock member 36, along with the lock bolt 38, is spring biased to an uppermost position thereof, i.e. toward the arming member 44, by a spring member 39, shown in the form of a coil spring 39. The latch member 40 is pivotably mounted to the casing 30 through a pivot pin 31.

The casing 30 of the latch assembly 20 is fixed to the body portion 12 of the trash container 10 by any appropriate means known in the art, such as by bolts, screws, rivets and the like fasteners extending through openings 68 formed in a flange 30*a* of the casing 30 of the latch assembly 20 or by adhesive bonding.

The solenoid actuator 34 includes an electronically actuated solenoid member 50 non-movably attached to the casing 30 within the internal cavity 32 thereof, and a recoprocatingly movable armature 52. A distal end of the armature 52 is secured to the latch member 40 so that the reciprocating movement of the armature 52 translates into pivoting movement of the latch member 40. Moreover, the armature 52 is spring biased to an extended, outermost position thereof away from the solenoid member 50 and toward the lock member 36 by a spring member 54, shown in the form of a coil spring 54. Correspondingly, the latch member 40 is spring biased in the direction toward the lock member 36 by the spring member 54.

Furthermore, as best illustrated in FIGS. 3 and 5, the latch member 40 is provided with a latching portion 41 facing the lock member 36, while the lock member 36 is provided with a lock portion 37 facing the latch member 40 and complementary to the latching portion 41 of the latch member 40. Moreover, in the locked position illustrated in FIG. 3, the lock portion 37 of the lock member 36 engages the latching portion 41 of the latch member 40, while in the unlocked position illustrated in FIG. 5, the lock portion 37 of the lock member 36 is disengaged from the latching portion 41 of the latch member 40.

All the components of the latch assembly 20 are disposed in the internal cavity 32 of the casing 30. Specifically, as best illustrated in FIGS. 3 and 5, the solenoid actuator 34, the lock member 36, the latch member 40, the arming portion 42, the arming member 44 are disposed inside the internal cavity 32 of the casing 30. The lock bolt 38 is at least partially disposed in the internal cavity 32 of the casing 30.

The lock bolt 38 of the latch assembly 20 is reciprocatingly movable between a locked position and an unlocked position. In the locked position, illustrated in FIG. 3, the lock bolt 38 is in a lowermost position thereof so as to engage an engagement member of the second end portion 26 of the locking strap 22. In the first exemplary embodiment of the present invention, the engagement member is in the form of an opening 28 in the second end portion 26 of the locking strap 22 (best shown in FIG. 4). Alternatively, the engagement member may be in the form of a hook formed at the second end portion 26 of the locking strap 22, or in any other appropriate form. In the unlocked position, best illustrated in FIG. 5, the lock bolt 38 is in an uppermost position thereof so as to withdraw within the internal cavity 32 of the casing 30 and disengage from the second end portion 26 of the locking strap 22.

As further illustrated in FIGS. 3 and 5, the latch assembly 20 according to the first exemplary embodiment of the present invention further comprises a guide plate 56 positioned substantially vertically and at least partially disposed in a guide groove 57 formed in the lock member 36. The guide groove 57 is complementary to the guide plate 56, which ensures linear reciprocating displacement of the lock member 36 and the lock bolt 38 in the substantially vertical direction.

The latch assembly 20 further comprises within the internal cavity 32 of the casing 30 one or more electrical batteries 58 (four batteries are shown in FIGS. 3 and 5) providing an electrical power to the solenoid actuator 34, and an electronic control module (ECM) 60 including a central processing unit (CPU) provided for controlling the operation of the solenoid actuator 34, and a signal receiver 62 for receiving a wireless signal, such as a radio-frequency (RF) signal, an infra-red (IR) signal, light signal, etc. Alternatively, the actuator 34 can be triggered by an accelerometer built into the electronic control module 60 for monitoring acceleration of the container 10. The accelerometer monitors acceleration in x, y and z of the container 10, looking for a predetermined acceleration profile of a typical dump motion cause by a trash truck.

The operation of the trash container 10 according to the present invention is as follows. Initially, the latch assembly 20 is in the unlocked position as illustrated in FIG. 5. The user locks the trash container 10 by placing the second end portion 26 of the locking strap 22 over the casing 30 of the latch assembly 20 so that a distal end of the second end portion 26 of the locking strap 22 is disposed in a receiver channel 33 of the casing 30. In the unlocked position, the opening 28 in the second end portion 26 of the locking strap 22 is oriented beneath the lock bolt 38 of the latch assembly 20 and is vertically and axially aligned therewith.

Then, the user manually moves the arming member 44 in the direction toward the arming portion 42 and against the biasing force of the spring member 46 by moving the knob 45. During this movement, oblique actuator surface 47 of the arming member 44 engages a corresponding and complementary oblique actuator surface 43 of the arming portion 42. As the arming member 44 moves further leftward (as best shown in FIG. 5), the arming member 44 pushes the arming portion 42 along with the lock member 36 and the lock bolt 38 of the latch assembly 20 downward (due to the interaction of two complementary oblique surfaces 43 and 47) until the lock portion 37 of the lock member 36 engages the latching portion 41 of the latch member 40. In this orientation of the lock member 36, the lock bolt 38 engages the opening 28 in the second end portion 26 of the locking strap 22 (as shown in FIGS. 1-3), thus placing the latch assembly 20 in the locked position so as to prevent unauthorized opening of the lid member 14 of the trash container 10. The engagement of the lock portion 37 of the lock member 36 by the latching portion 41 of the latch member 40 prevents upward movement of the lock member 36 along with the lock bolt 38 by the biasing force of the spring member 39, thus keeping the latch assembly 20 in the locked position, as illustrated in FIG. 3.

Figure 6:
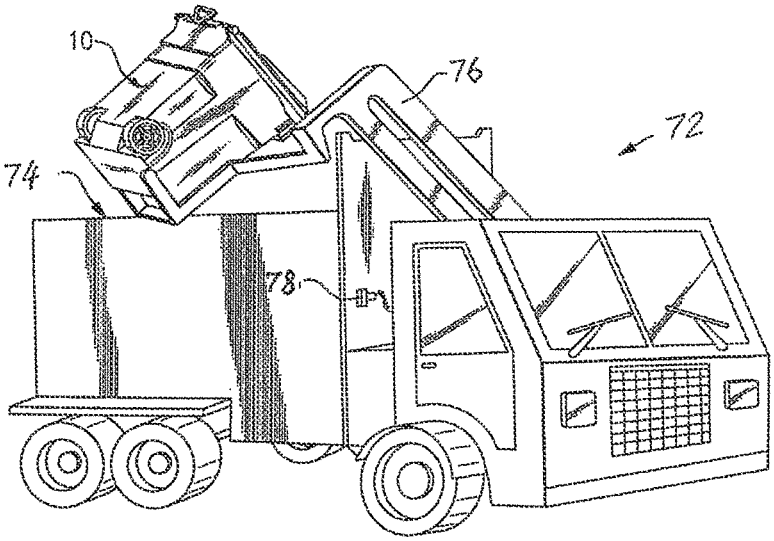
FIG. 6 is a perspective view of a trash truck tipping the residential trash container according to the first exemplary embodiment of the present invention in the closed position.
Figure 7:
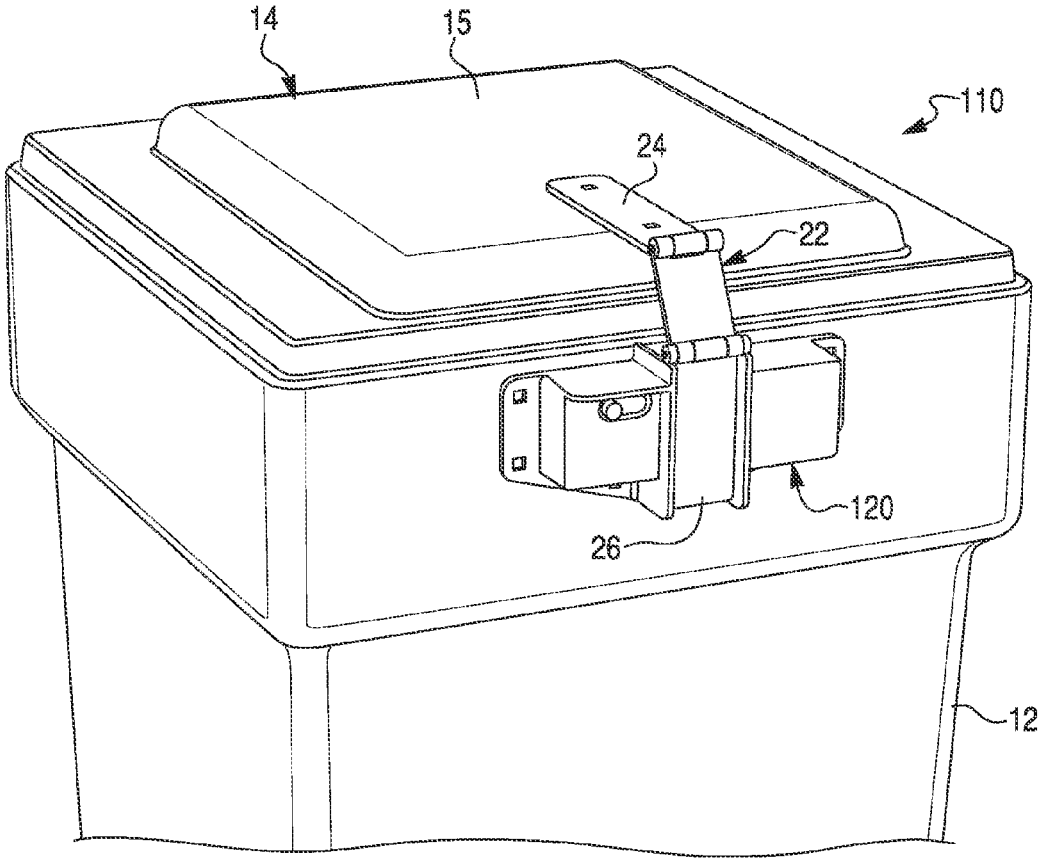
FIG. 7 is a perspective view of a residential trash container according to a second exemplary embodiment of the present invention.

As shown in FIG. 6, a lift arm 76 extending from a trash truck 72 lifts and tips the trash container 10 to empty the residential trash from the trash container 10 into a trash bin 74 of the trash truck 72. The trash truck 72 is provided with a wireless ID signal transmitter 78, such as a radio-frequency (RF), infra-red (IR) or light signal transmitter. The signal transmitter 78 remotely controls the solenoid actuator 34 by sending a wireless ID signal from the trash truck 72 to the signal receiver 62 of the latch assembly 20 (much like known remote garage door openers).

In operation, when the trash truck 72 approaches the trash container 10, the signal transmitter 78 automatically sends the wireless ID signal to the signal receiver 62. If the electronic control module 60 determines that the appropriate ID signal is received, the ECM 60 located in the casing 30 activates the solenoid actuator 34. When the solenoid actuator 34 is actuated, the solenoid 50 causes the distal end of the armature 52 to retract to the innermost position thereof against the biasing force of the spring member 54. Concurrently, the armature 52 of the solenoid actuator 34 causes the latch member 40 to pivot in the direction away from the lock member 36 so as to disengage the latching portion 41 of the latch member 40 from the lock portion 37 of the lock member 36. As soon as the lock portion 37 of the lock member 36 is disengaged from the latching portion 41 of the latch member 40, the lock bolt 38 moves upward away from the opening 28 in the second end portion 26 of the locking strap 22 to the unlocked position, illustrated in FIGS. 4 and 5. In this position, the trash container 10 is ready to be emptied by the trash truck 72.

The latch assembly 20 further includes a manual lock 80 for manually unlocking the latch assembly 20. The manual lock 80 is disposed within the internal cavity 32 of the casing 30 and has a key slot 82 accessible from the outside of the casing 30 of the latch assembly 20. The manual lock 80 is electrically connected to the solenoid actuator 34 through the electronic control module 60, and is operated by a passkey. In order to manually open the latch assembly 20, the user inserts the passkey into the key slot 82 of the manual lock 80 and, by turning the inserted passkey in a predetermined direction or otherwise, the ECM 60 triggers the solenoid actuator 34 to unlock the latch assembly 20 by releasing the lock member 36.

Alternatively, the manual lock 80 is mechanically connected to the latch member 40 and is operated by a key. In order to manually open the latch assembly 20, the user inserts the key into the key slot 82 of the manual lock 80 and, by turning the inserted key in a predetermined direction moves the latch member 40 away from the lock portion 37 of the lock member 36 to unlock the latch assembly 20 by releasing the lock member 36.

FIGS. 7-10 illustrate a second exemplary embodiment of a residential trash or recycling container 110 provided with an automatic latch assembly, generally depicted by the reference character 120. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 100 has been added, sometimes without being described in detail since similarities between the corresponding parts in the two embodiments will be readily perceived by the reader.

Figure 9:
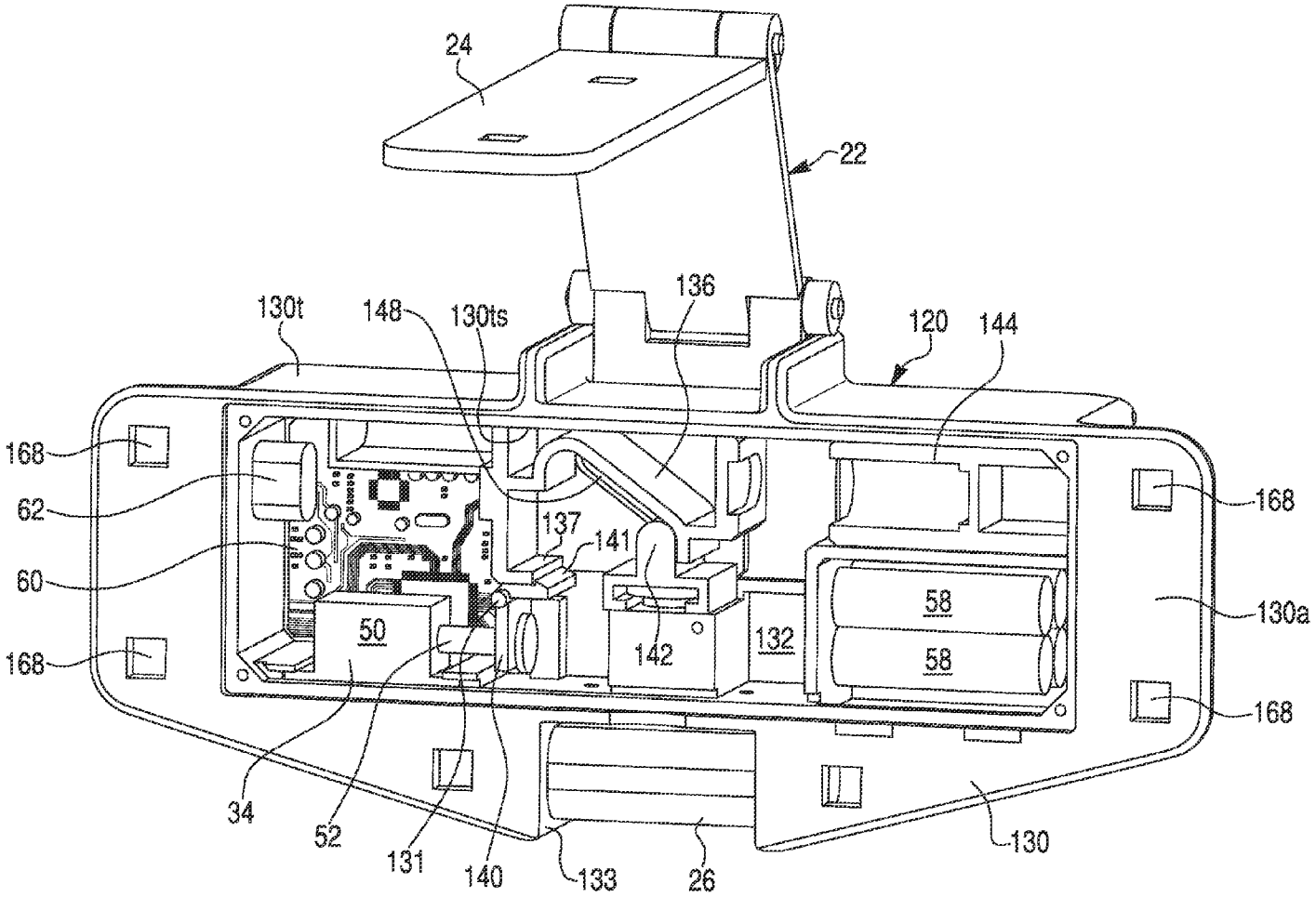
FIG. 9 is a perspective view showing components of the latch assembly according to the second exemplary embodiment of the present invention in a locked position.
Figure 10:
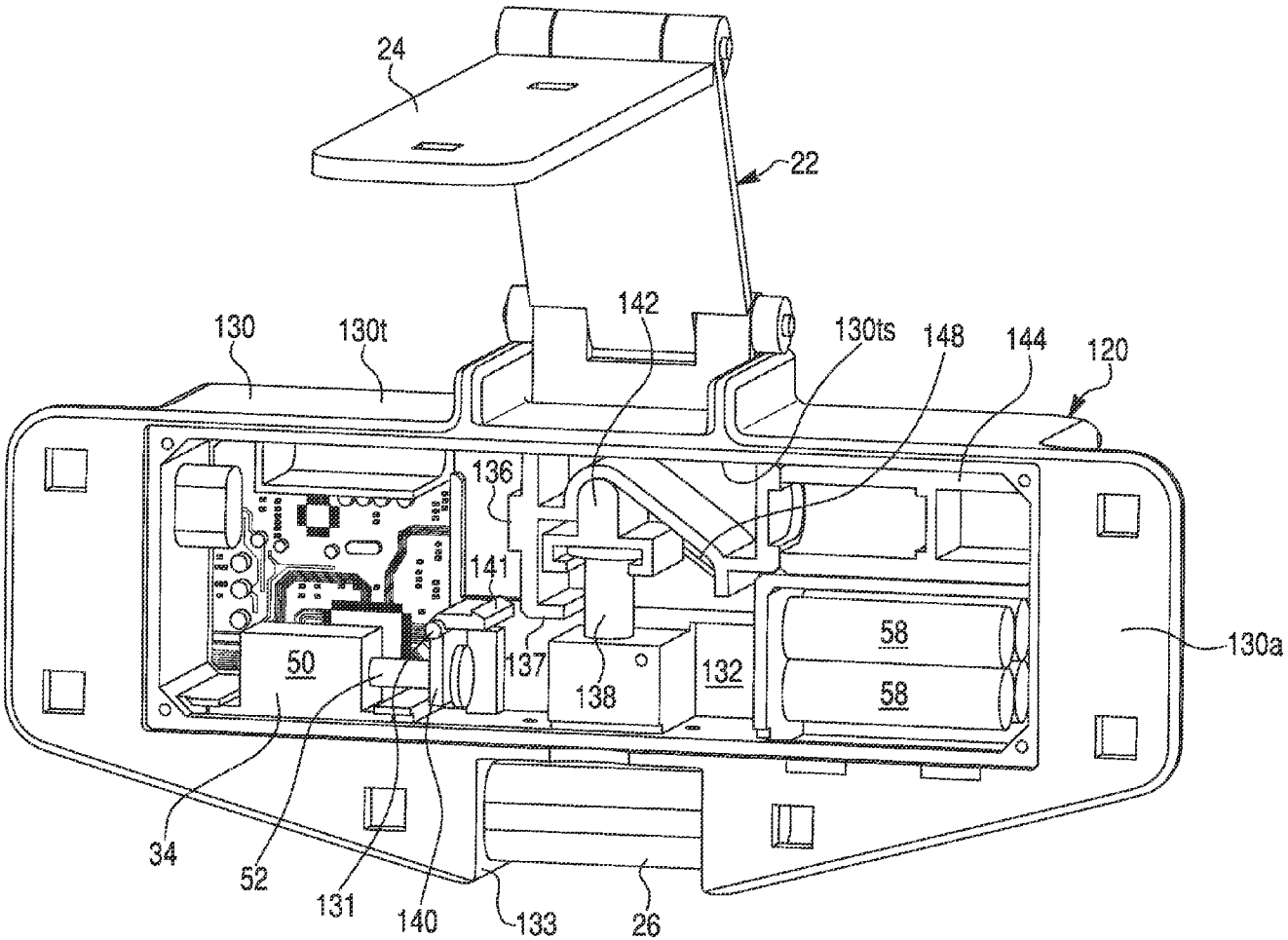
FIG. 10 is a perspective view showing the components of the latch assembly according to the second exemplary embodiment of the present invention in the unlocked position.

The latch assembly 120 according to the second exemplary embodiment of the present invention, comprises a casing 130 fixed (i.e., non-movably secured) to the body portion 12 of the container 10 in a manner similar to the latch assembly 20 according to the first exemplary embodiment of the present invention. The casing 130 also defines an internal cavity 32 therein. The latch assembly 120 further comprises an electromagnetic actuator, such as a solenoid actuator 34, a lock member 136 operatively associated with a lock bolt 138, a latch member (or trigger) 140 mounted to the casing 130 and pivotably movable relative to the reciprocating lock member 136, an arming portion 142 non-movably attached to the lock bolt 138. As best shown in FIGS. 9 and 10, the lock bolt 138 linearly reciprocates in a first (vertical) direction, while the lock member 136 linearly reciprocates in a second (horizontal) direction substantially perpendicular to the first direction. Furthermore, the lock member 136 is provided with an oblique actuator surface 148 that engages an acting surface of the arming portion 142 so that the reciprocative linear motion of the lock member 136 in the second direction translates into the reciprocative linear motion of the lock bolt 138 in the first direction.

Figure 8:
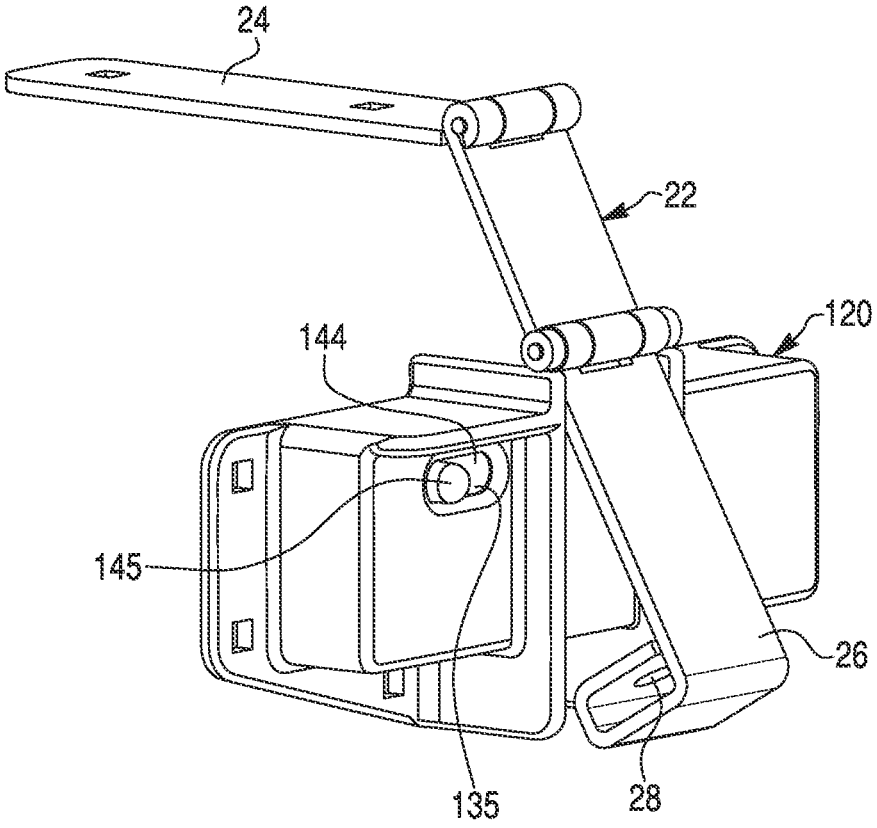
FIG. 8 is a perspective view of an automatic latch assembly according to the second exemplary embodiment of the present invention in an unlocked position.

The latch assembly 120 further comprises an arming member 144 reciprocating in the second direction, i.e. substantially perpendicular to the reciprocating direction of the lock bolt 138 and substantially parallel to the reciprocating direction of the lock member 136. In other words, as best illustrated in FIGS. 9 and 10, both the lock member 136 and the arming member 144 reciprocate in the substantially horizontal (or second) direction. The arming member 144 may be spring biased to a position away from the lock member 136 by a spring member. The arming member 144 includes a knob 145 integrally formed therewith. As best shown in FIG. 8, the knob 145 of the arming member 144 extends from the internal cavity 132 of the casing 130 through an elongated, substantially horizontal opening 135 in the casing 130. The knob 145 is provided for manually moving the arming member 144 by the user in the horizontal (or second) direction.

The lock bolt 138 is spring biased to an uppermost position thereof, i.e. away from a receiver channel 133 of the casing 130, by a spring member in a manner similar to the latch assembly 20 according to the first exemplary embodiment of the present invention, so as to slidingly engage the oblique actuator surface 148 of the lock member 136. The latch member 140 is pivotably mounted to the casing 130 through a pivot pin 131.

The casing 130 of the latch assembly 120 is fixed to the body portion 12 of the trash container 10 by any appropriate means known in the art, such as by fasteners extending through openings 168 formed in a flange 130*a* of the casing 130 or by adhesive bonding.

The solenoid actuator 34 includes a solenoid member 50 non-movably attached to the casing 30 within the internal cavity 132 thereof, and a recoprocatingly movable armature 52. A distal end of the armature 52 is secured to the latch member 140 so that the reciprocating movement of the armature 52 translates into the pivoting movement of the latch member 140. Moreover, the armature 52 can be spring biased to an extended, outermost position thereof away from the solenoid member 50 and toward the lock member 36 by a spring member in a manner similar to the first exemplary embodiment of the present invention. Correspondingly, the latch member 140 is spring biased in the direction toward the lock member 136.

Furthermore, as best illustrated in FIGS. 9 and 10, the latch member 140 is provided with a latching portion 141 facing the lock member 136, while the lock member 136 is provided with a lock portion 137 facing the latching portion 141 of the latch member 140. Moreover, in the locked position illustrated in FIGS. 7 and 9, the latching portion 41 of the latch member 40 engages the lock portion 137 of the lock member 136 so as to prevent the reciprocative linear motion of the lock member 136 in the second direction, while in the unlocked position illustrated in FIGS. 8 and 10, the lock portion 137 of the lock member 136 is disengaged from the latching portion 141 of the latch member 140, thus allowing the reciprocative linear motion of the lock member 136 in the second direction.

Similarly to the first exemplary embodiment of the present invention, all the components of the latch assembly 120 are disposed in the internal cavity 132 of the casing 130. Specifically, as illustrated in FIGS. 9 and 10, the solenoid actuator 34, the lock member 136, the latch member 140, the arming portion 142, the arming member 144 are disposed inside the internal cavity 132 of the casing 130. The lock bolt 138 is at least partially disposed in the internal cavity 132 of the casing 130.

The lock bolt 138 of the latch assembly 120 is reciprocatingly movable between a locked position and an unlocked position in the first (or vertical) direction. In the locked position, illustrated in FIG. 9, the lock bolt 138 is in a lowermost position thereof so as to engage an engagement member of the second end portion 26 of the locking strap 22. In the second exemplary embodiment of the present invention, the engagement member is in the form of an opening 28 in the second end portion 26 of the locking strap 22 (shown in FIGS. 7 and 8). Alternatively, the engagement member may be in the form of a hook formed at the second end portion 26 of the locking strap 22, or in any other appropriate form. In the unlocked position, illustrated in FIG. 10, the lock bolt 138 is in an uppermost position thereof so as to withdraw within the internal cavity 132 of the casing 130 and disengage from the second end portion 26 of the locking strap 22.

As further illustrated in FIGS. 9 and 10, the lock member 136 of the latch assembly 120 slidingly engages an inner surface 130*ts* of a top wall 130*t* of the casing 130 which ensures linear reciprocating displacement of the lock member 136 in the substantially horizontal (or second) direction by sliding along the inner surface 130*ts* of the top wall 130*t*.

The latch assembly 120 further comprises within the internal cavity 32 of the casing 30 one or more electrical batteries 58 (four batteries are shown in FIGS. 9 and 10) providing an electrical power to the solenoid actuator 34, and an electronic control module (ECM) 60 including a central processing unit (CPU) provided for controlling the operation of the solenoid actuator 34, and a signal receiver 62 for receiving a wireless signal, such as a radio-frequency (RF) signal, an infra-red (IR) signal, light signal, etc. Alternatively, the actuator 34 can be triggered by an accelerometer built into the electronic control module 60 for monitoring acceleration of the container 10. The accelerometer monitors acceleration in x, y and z of the container 10, looking for a predetermined acceleration profile of a typical dump motion cause by a trash truck.

The operation of the trash container 110 according to the present invention is as follows. Initially, the latch assembly 120 is in the unlocked position as illustrated in FIG. 8. The user locks the trash container 110 by placing the second end portion 26 of the locking strap 22 over the casing 130 of the latch assembly 120 so that a distal end of the second end portion 26 of the locking strap 22 is disposed in a receiver channel 133 of the casing 130. In the unlocked position, the opening 28 in the second end portion 26 of the locking strap 22 is oriented beneath the lock bolt 138 of the latch assembly 120 and is vertically and axially aligned therewith. Then, the user manually moves the arming member 144 in the direction toward the lock member 136 by moving the knob 145. During this movement, the arming member 144 engages the lock member 136. As the arming member 144 moves further leftward (as shown in FIGS. 9 and 10), the arming member 144 pushes the lock member 136 linearly in the second direction toward the latch member 140. At the same time, as the lock member 136 moves leftwards, the actuator surface 148 of the lock member 136 engages and pushes the arming portion 142 and the lock bolt 138 of the latch assembly 120 downward (due to the interaction of the arming portion 142 and the oblique actuator surface 148) until the lock portion 137 of the lock member 316 engages the latching portion 141 of the latch member 140. In this orientation of the lock member 136, the lock bolt 138 engages the opening 28 in the second end portion 26 of the locking strap 22 (as shown in FIG. 9), thus placing the latch assembly 120 in the locked position thereof so as to prevent unauthorized opening of the lid member 14 of the trash container 110. The engagement of the lock portion 137 of the lock member 136 by the latching portion 141 of the latch member 140 prevents lateral movement of the lock member 136 and upward movement of the lock bolt 138 by the biasing force of the spring member, thus keeping the latch assembly 120 in the locked position, as illustrated in FIG. 9.

The latch assembly 120, according to the second exemplary embodiment of the present invention, operates in a manner similar to the latch assembly 20 according to the first exemplary embodiment of the present invention. Specifically, the lift arm 76 extending from the trash truck 72 (shown in FIG. 6) lifts and tips the trash container 110 to empty residential trash from the trash container 110 into a trash bin 74 of the trash truck 72. The trash truck 72 is provided with a wireless ID signal transmitter 78, such as a radio-frequency (RF), infra-red (IR) or light signal transmitter. The signal transmitter 78 remotely controls the solenoid actuator 34 by sending the wireless ID signal from the trash truck 72 to the signal receiver 62 of the latch assembly 120.

FIGS. 11-15 illustrate a residential trash or recycling container provided with an automatic latch assembly according to a third exemplary embodiment of the present invention, generally depicted by the reference character 220. Components, which are unchanged from the first exemplary embodiments of the present invention, are labeled with the same reference characters. Components, which function in the same way as in the first exemplary embodiment of the present invention depicted in FIGS. 1-6 are designated by the same reference numerals to some of which 200 has been added, sometimes without being described in detail since similarities between the corresponding parts in the two embodiments will be readily perceived by the reader.

The latch assembly 220 can be manipulated between a locked position preventing an opening of the lid member 14 of the container 10 and an unlocked position allowing the opening of the lid member 14. The latch assembly 220 according to the third exemplary embodiment of the present invention, comprises a casing 230 fixed (i.e., non-movably secured) to the body portion 12 of the container 10 in a manner similar to the latch assembly 20 according to the first exemplary embodiment of the present invention. The casing 230 also defines an internal cavity 232 therein. The latch assembly 220 further comprises an actuator in the form of an electric motor/gear reducer assembly 234, a lock member 236 non-movably attached to a lock bolt 238 for reciprocating displacement therewith in a first, substantially vertical, direction, a latch member (or trigger) 240 mounted to the casing 230 and pivotably movable relative to the reciprocating lock member 236, and an arming member 244 rotatably mounted to the casing 230. Alternatively, the actuator 234 may be in the form of an electromagnetic actuator, such as a solenoid actuator. In other words, as illustrated in FIGS. 12-15, the lock member 236 and the lock bolt 238 reciprocate in the substantially vertical first direction, while the arming member 244 rotates about a substantially horizontal axis. The arming member 244 is provided with an actuator arm 247 provided to slidably engage the lock member 236.

As best illustrated in FIGS. 12-15, during the rotational movement of the arming member 244 counterclockwise (as seen in FIGS. 12-15), the actuator arm 247 of the arming member 244 engages the lock member 236 and pushes the lock member 236 with the lock bolt 238 downward. In other words, the rotational movement of the arming member 244 translates into the linear displacement of the lock member 236 and the lock bolt 238 in the first direction.

Figure 11:
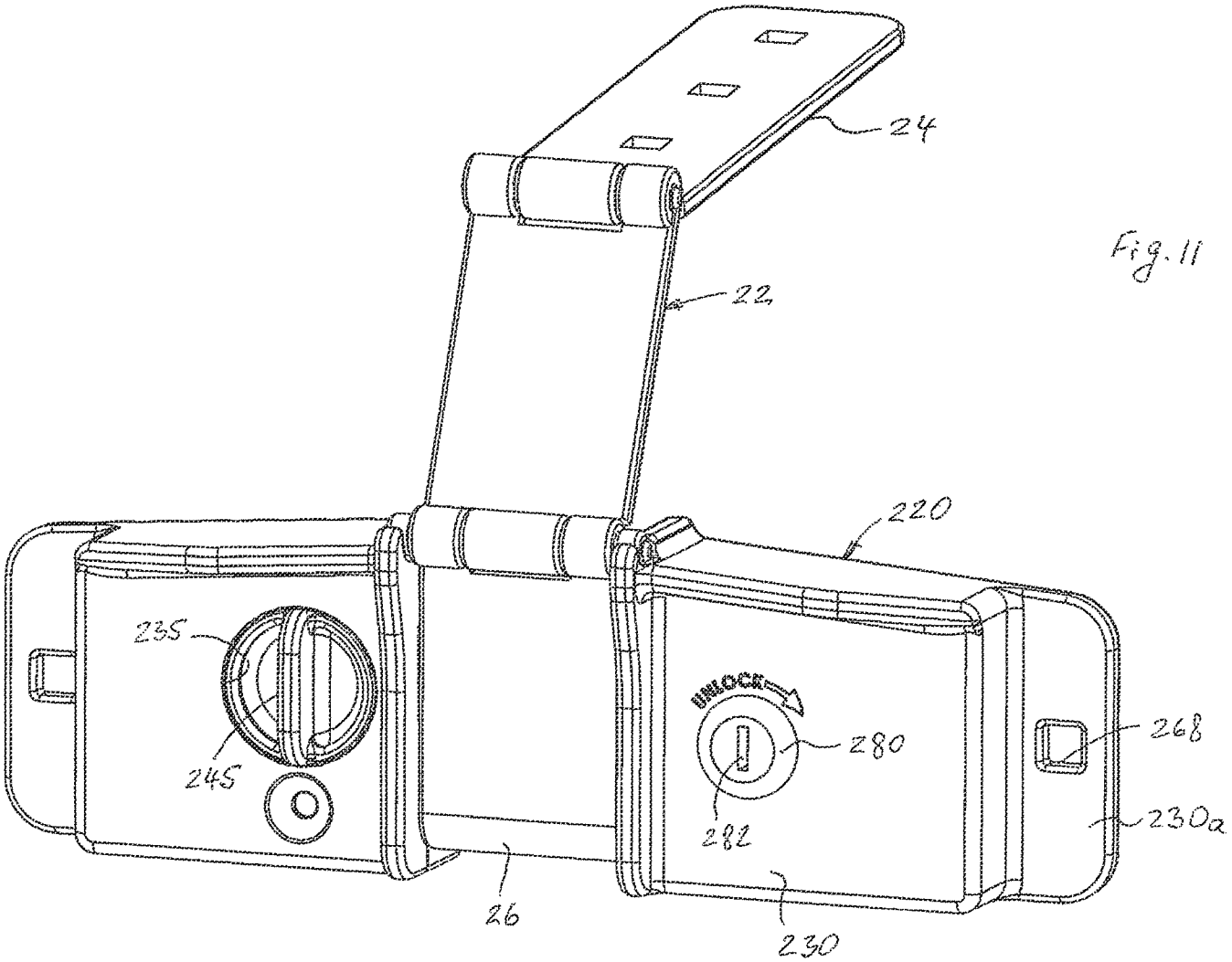
FIG. 11 is a perspective view of an automatic latch assembly according to a third exemplary embodiment of the present invention in a locked position.

The arming member 244 includes a knob 245 integrally formed therewith. As best shown in FIG. 11, the knob 245 of the arming member 244 extends from the internal cavity 232 of the casing 230 through a circular opening 235 in the casing 230. The knob 245 is provided for manually moving the arming member 244 by the user.

The lock member 236, along with the lock bolt 238, is spring biased to an uppermost position thereof, i.e. toward the actuator arm 247 of the arming member 244, by a spring member 239, shown in the form of a coil spring 239. The latch member 240 is pivotably mounted to the casing 230 through a pivot pin 231.

The casing 230 of the latch assembly 220 is fixed to the body portion 12 of the trash container 10 by any appropriate means known in the art, such as by fasteners extending through openings 268 formed in a flange **230*a* of the casing 230 of the latch assembly 220** or by adhesive bonding.

The electric motor/gear reducer assembly 234 includes an electric motor/gear reducer 250 non-movably attached to the casing 230 within the internal cavity 232 thereof, a rotatable motor shaft 252, an actuator wheel 253 fixed (non-rotatably attached) to a distal end of the motor shaft 252, and an actuator link 255 drivingly coupling the actuator wheel 253 with the latch member 240. The actuator wheel 253 is drivingly coupled to the latch member 240 so that the rotational movement of the motor shaft 252 translates into the pivoting movement of the latch member 240.

Furthermore, as illustrated in FIGS. 12-15, the latch member 240 is provided with a latching portion 241 facing the lock member 236, while the lock member 236 is provided with a lock portion 237 facing the latch member 240 and complementary to the latching portion 241 of the latch member 240. Moreover, in the locked position illustrated in FIGS. 12 and 13, the lock portion 237 of the lock member 236 engages the latching portion 241 of the latch member 240, while in the unlocked position illustrated in FIGS. 14 and 15, the lock portion 237 of the lock member 236 is disengaged from the latching portion 241 of the latch member 240.

All the components of the latch assembly 220 are disposed in the internal cavity 232 of the casing 230. Specifically, as illustrated in FIGS. 12-15, the actuator 234, the lock member 236, the latch member 240, the arming member 244 are disposed inside the internal cavity 232 of the casing 230. The lock bolt 238 is at least partially disposed in the internal cavity 232 of the casing 230.

The lock bolt 238 of the latch assembly 220 is reciprocatingly movable between a locked position and an unlocked position. In the locked position, illustrated in FIG. 12-13, the lock bolt 238 is in a lowermost position thereof so as to engage an engagement member 28 of the second end portion 26 of the locking strap 22. In the third exemplary embodiment of the present invention, the engagement member is in the form of an opening 28 in the second end portion 26 of the locking strap 22 (shown in FIG. 4). Alternatively, the engagement member may be in the form of a hook formed at the second end portion 26 of the locking strap 22, or in any other appropriate form. In the unlocked position, illustrated in FIG. 5, the lock bolt 238 is in an uppermost position thereof so as to withdraw within the internal cavity 232 of the casing 230 and disengage from the second end portion 26 of the locking strap 22.

The latch assembly 220 further comprises within the internal cavity 232 of the casing 230 one or more electrical batteries 58 (four batteries are shown in FIGS. 12-15) providing an electrical power to the electric motor/gear reducer assembly 234, and an electronic control module 260 including a central processing unit (CPU) provided for controlling the operation of the electric motor/gear reducer assembly 234, and an accelerometer 262 built into the electronic control module 260 for monitoring acceleration of the container 10. The electronic control module 260 is electrically connected to the accelerometer 262 for controlling the operation of the electric motor/gear reducer assembly 234 in response to data from the accelerometer 262. Specifically, the accelerometer 262 monitors acceleration in x, y and z of the container 10, looking for a predetermined acceleration profile of a typical dump motion cause by a trash truck 72. All other motions will be ignored, such as being tipped upside down by a person/animal or nature. Alternatively, the actuator 234 can be triggered by wireless signal from an outside source.

Figure 14:
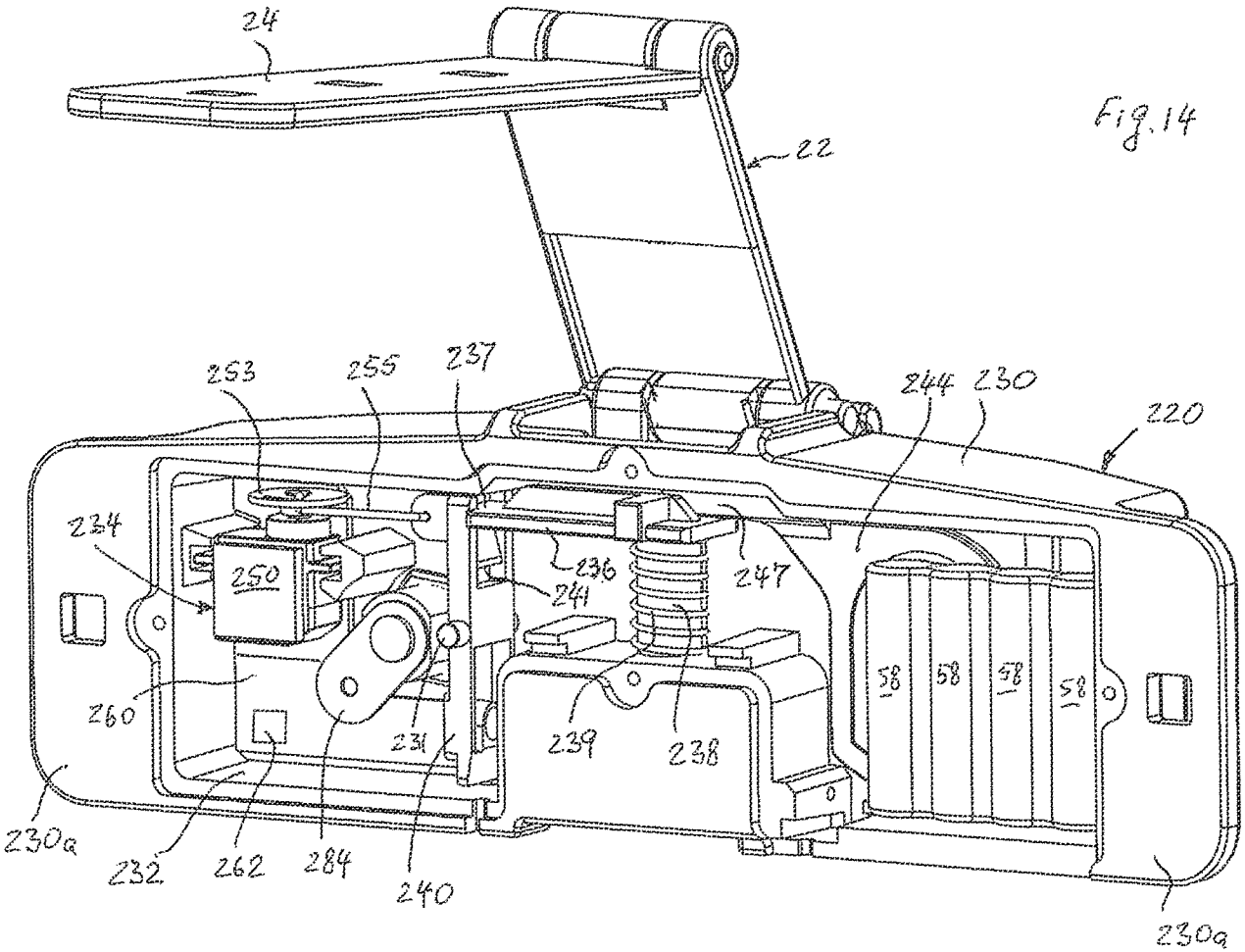
FIG. 14 is a perspective view showing components of the latch assembly according to the third exemplary embodiment of the present invention in an unlocked position.
Figure 15:
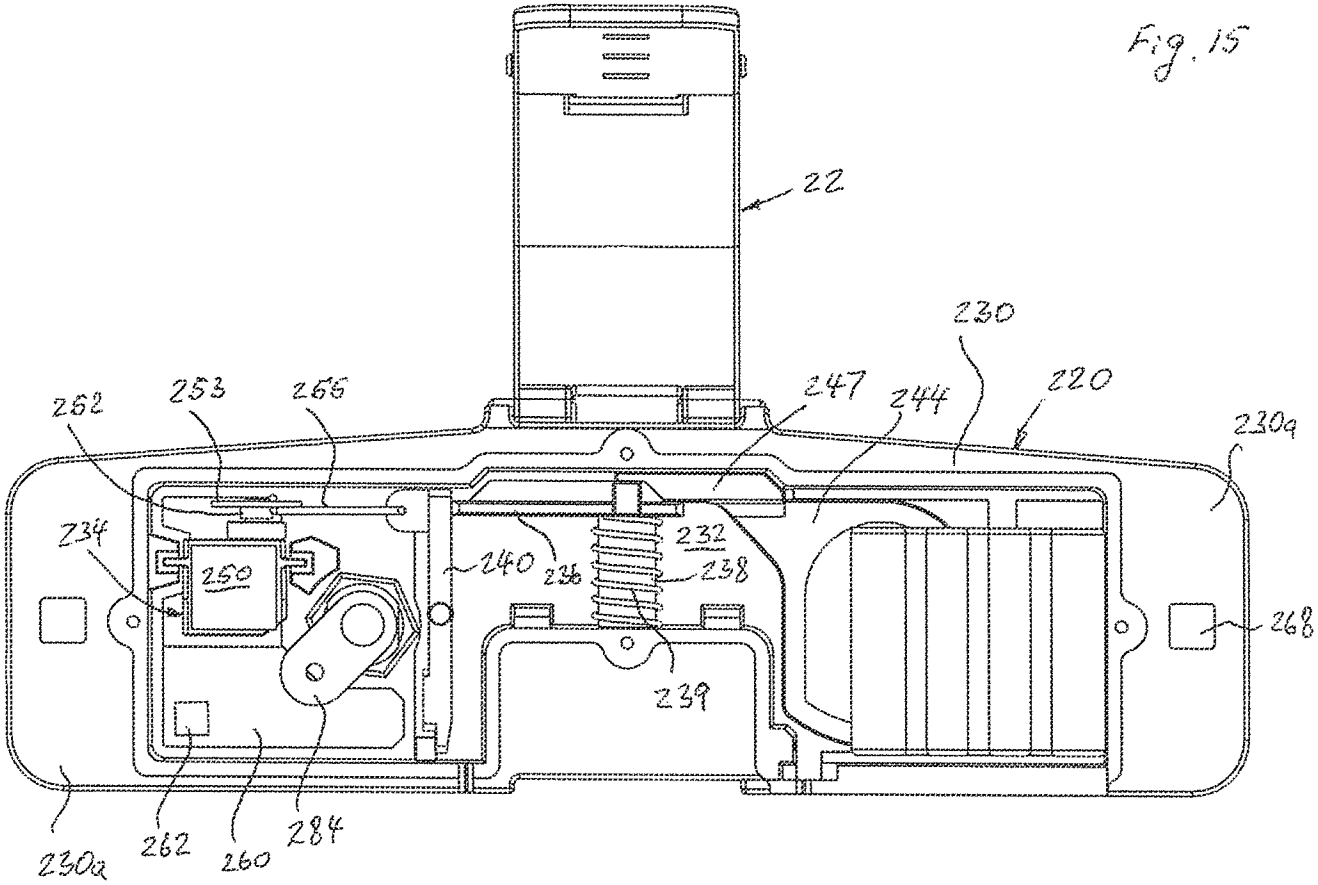
FIG. 15 is a sectional view showing components of the latch assembly according to the third exemplary embodiment of the present invention in the unlocked position.

The operation of the latch assembly 220 according to the third exemplary embodiment of the present invention is as follows. Initially, the latch assembly 220 is in the unlocked position as illustrated in FIGS. 14-15. The user locks the trash container by placing the second end portion 26 of the locking strap 22 over the casing 30 of the latch assembly 20 so that a distal end of the second end portion 26 of the locking strap 22 is disposed in a receiver channel 33 of the casing 30. In the unlocked position, the engagement member 28 in the second end portion 26 of the locking strap 22 is oriented beneath the lock bolt 238 of the latch assembly 220 and is vertically and axially aligned therewith.

Figure 12:
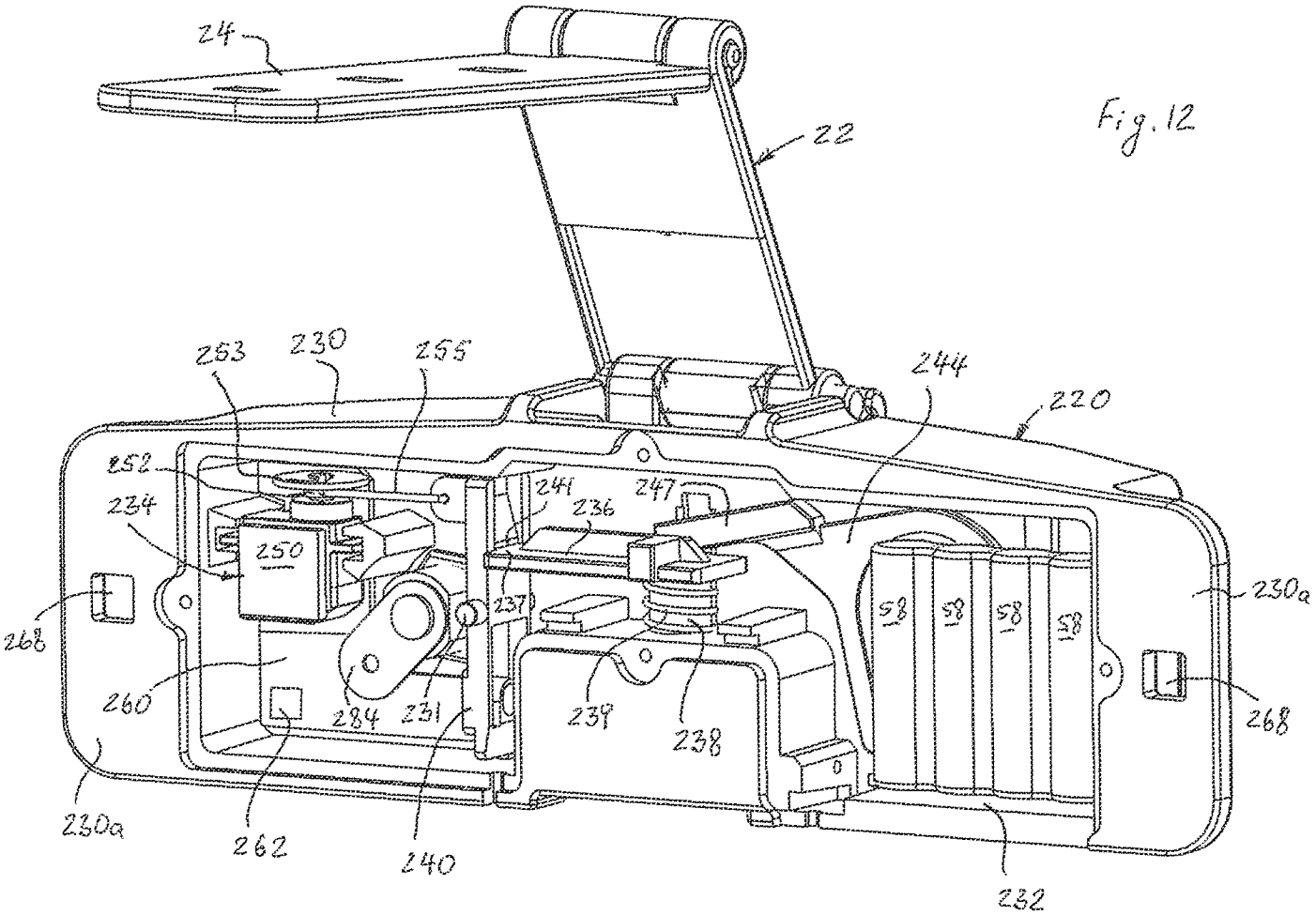
FIG. 12 is a perspective view showing components of the latch assembly according to the third exemplary embodiment of the present invention in the locked position.
Figure 13:
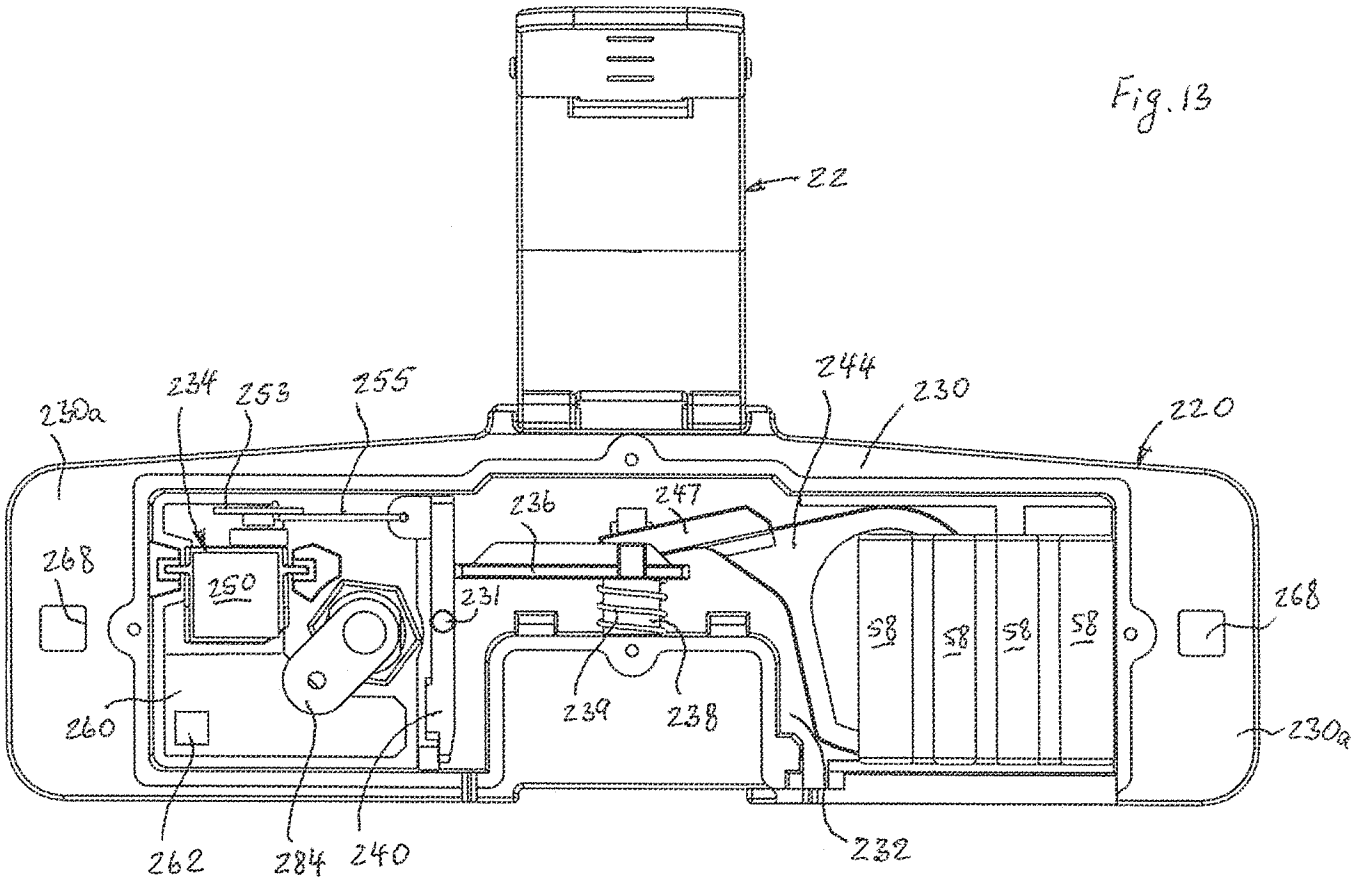
FIG. 13 is a sectional view showing components of the latch assembly according to the third exemplary embodiment of the present invention in the locked position.

Then, the user manually rotates the arming member 244 in the direction toward the lock member 236 and against the biasing force of the spring member 239 by moving the knob 245 clockwise (as seen in FIG. 11). During this movement, the actuator arm 247 of the arming member 244 engages the lock member 236. As the arming member 244 rotates further clockwise (as seen in FIGS. 12-15), the actuator arm 247 of the arming member 244 pushes the lock member 236 along with the lock bolt 238 of the latch assembly 220 downward until the lock portion 237 of the lock member 236 engages the latching portion 241 of the latch member 240. In this orientation of the lock member 236, the lock bolt 238 engages the engagement member 28 at the second end portion 26 of the locking strap 22, thus placing the latch assembly 220 in the locked position thereof so as to prevent unauthorized opening of the lid member 14 of the trash container. The engagement of the lock portion 237 of the lock member 236 by the latching portion 241 of the latch member 240 prevents upward movement of the lock member 236 along with the lock bolt 238 by the biasing force of the spring member 239, thus keeping the latch assembly 220 in the locked position, as illustrated in FIGS. 12-13.

As shown in FIG. 6, a lift arm 76 extending from a trash truck 72 lifts and tips the trash container 10 to empty residential trash from the trash container 10 into a trash bin 74 of the trash truck 72. In operation, when the trash truck 72 lifts the trash container 10, the accelerometer 262 generates signal related to acceleration in x, y and z of the container 10, and sends the signal to the electronic control module 260. When the electronic control module 260 determines the predetermined acceleration profile of a typical dump motion cause by the trash truck 72 based on the signal received from the accelerometer 262, the ECM 260 activates the actuator 234.

When the actuator 234 is actuated, the electric motor/gear reducer 250 causes the motor shaft 252 to rotate. Concurrently, the actuator wheel 253 of the actuator 234 causes (through the actuator link 255) the latch member 240 to pivot in the direction away from the lock member 236 so as to disengage the latching portion 241 of the latch member 240 from the lock portion 237 of the lock member 236. As soon as the lock portion 237 of the lock member 236 is disengaged from the latching portion 241 of the latch member 240, the lock bolt 238 moves upward away from the engagement member 28 at the second end portion 26 of the locking strap 22 to the unlocked position, illustrated in FIGS. 14 and 15. In this position, the trash container is ready to be emptied by the trash truck 72.

The latch assembly 220 further includes a manual lock 280 for manually unlocking the latch assembly 220. The manual lock 280 is disposed within the internal cavity 232 of the casing 230 and has a key slot 282 accessible from the outside of the casing 230 of the latch assembly 220. The manual lock 280 is mechanically connected to the latch member 240 and is operated by a key. Specifically, the manual lock 280 includes an actuating lever 284 disposed within the casing 240 and rotatable relative to the casing 230 by the key from the outside of the casing 230. When the key is inserted into the key slot 282 of the manual lock 280 and turned, the actuating lever 284 engages the latch member 240 so as to cause the latch member 240 to pivot about the pivot pin 231 in the direction away from the lock member 236 so as to disengage the latching portion 241 of the latch member 240 from the lock portion 237 of the lock member 236. As soon as the lock portion 237 of the lock member 236 is disengaged from the latching portion 241 of the latch member 240, the lock bolt 238 moves upward away from the engagement member 28 at the second end portion 26 of the locking strap 22 to the unlocked position, illustrated in FIGS. 14 and 15. In this position, the trash container is ready to be emptied.

The container with an automatic latch assembly according to the present invention has a number of advantages over gravity activated locks:

1. The container can be knocked over by wind, animals or people in any direction without opening. Thus making it spill proof, it can even be tipped upside down.

2. The container unlocks automatically when a trash truck is near. No action is required by driver.

3. A user has the ability to log when the latch assembly was activated by truck and or if the container was dumped.

The container according to the present invention can also cross over into locks that talk to alarms systems. Motion, sound, vibration, tilt, etc. sensors could trigger a home or business alarm silently or with audible sound.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A container, comprising:

a hollow body portion having a closed bottom and an open top;

a hinged lid member pivotally attached to said body portion so as to be selectively movable between an open position to access said container and a closed position to close said open top thereof and restrict access to said container;

a latch assembly fixed to one of said body portion and said lid member; and a locking strap having a first end portion fixed to another of said body portion and said lid member, and a second end portion disposed opposite to said first end portion and provided with an engagement member;

said latch assembly comprising:

a casing defining an internal cavity therein, said casing fixed to one of said body portion and said lid member;

a lock bolt reciprocating linearly between a locked position preventing an opening of said lid member of said container and an unlocked position allowing the opening of said lid member, said lock bolt engaging said engagement member of said second end portion of said locking strap in said locked position, said lock bolt being disengaged from said engagement member of said second end portion of said locking strap in said unlocked position;

an actuator secured within said internal cavity of said casing for moving said lock bolt out of engagement with said engagement member;

one of a signal receiver for receiving a wireless signal and an accelerometer for monitoring acceleration of said container; and an electronic control module electrically connected to the one of said signal receiver and said accelerometer for controlling the operation of said actuator in response to one of said wireless signal and data from said accelerometer.

2. The container as defined in claim 1, wherein said latch assembly further comprises:

a lock member reciprocating linearly within said internal cavity and operatively associated with said lock bolt; and a latch member mounted within said internal cavity and movable relative to said reciprocating lock member;

said lock member reciprocating between an engagement position such that said lock member engages said latch member so as to retain said lock bolt in said closed position thereof, and a disengaged position such that said lock member is disengaged from said latch member so as to allow said lock bolt to move to said unlocked position thereof.

3. The container as defined in claim 2, wherein said latch member is movable by said actuator to disengage said latch member from said lock member causing said lock bolt to move to said unlocked position thereof.

4. The container as defined in claim 3, wherein said latch member is pivotably movable relative to said linearly reciprocating lock member; and wherein said actuator is pivotally moving said latch member out of engagement with said lock member.

5. The container as defined in claim 4, wherein said actuator is in the form of an electromagnetic actuator including an electromagnet non-movably attached to said casing within said internal cavity thereof and a recoprocatingly movable armature; and wherein a distal end of said armature is secured to said latch member so that the reciprocating movement of said armature translates into the pivotal movement of said latch member.

6. The container as defined in claim 5, wherein said armature is spring biased to an extended, outermost position thereof away from said solenoid member.

7. The container as defined in claim 4, wherein said electrical actuator is in the form of an electric motor non-movably attached to said casing within said internal cavity thereof; said electric motor having a movable shaft drivingly coupled to said latch member so that the operational movement of said movable shaft translates into the pivotal movement of said latch member.

8. The container as defined in claim 2, wherein both said lock bolt and said lock member linearly reciprocate in a first direction.

9. The container as defined in claim 8, wherein said latch assembly further comprises a guide plate fixed to said casing within said internal cavity and extending in said first direction; wherein said guide plate at least partially disposed in a guide groove formed in said lock member; and wherein said guide groove is complementary to said guide plate so as to ensure reciprocating linear displacement of said lock member and said lock bolt in said first direction.

10. The container as defined in claim 8, wherein said latch assembly further comprises an arming member such that the movement of said arming mamber causes the movement of said lock bolt toward said locked position thereof and the movement of said lock member toward said engagement position thereof.

11. The container as defined in claim 10, wherein said arming member linearly reciprocates in a second direction substantially perpendicular to said first direction.

12. The container as defined in claim 10, wherein said arming member is pivotable relative to said casing.

13. The container as defined in claim 2, wherein said lock bolt reciprocates in a first direction and said lock member reciprocates in a second direction substantially perpendicular to said first direction.

14. The container as defined in claim 13, wherein said lock member includes an actuator surface engaging said lock bolt such that the reciprocating linear movement of said lock member in said second direction causes the corresponding reciprocating linear movement of said lock bolt in said first direction toward and away from said locked and unlocked positions thereof.

15. The container as defined in claim 14, wherein said latch assembly further comprises an arming member such that the movement of said arming member causes the movement of said lock bolt toward said locked position thereof and the movement of said lock member toward said engagement position thereof and wherein said arming member reciprocates in said second direction.

16. The container as defined in claim 1, wherein said lock bolt is spring biased to said unlocked position thereof.

17. The container as defined in claim 1, wherein said latch assembly further comprises an arming member such that the movement of said arming member causes the movement of said lock bolt toward said locked position thereof; and wherein said arming member includes a knob integrally formed therewith and extending from said internal cavity of said casing for manually moving said arming member by a user.

18. The container as defined in claim 17, wherein said arming member reciprocates in the direction substantially perpendicular to the reciprocating direction of said lock bolt.

19. The container as defined in claim 17, wherein said arming member is pivotable relative to said casing.

20. The container as defined in claim 1, wherein said actuator includes one of an electromagnet and an electric motor.

21. The container as defined in claim 1, wherein said latch assembly further comprises a manual lock for manually unlocking said latch assembly; wherein said manual lock is disposed within said internal cavity of said casing and has a key slot accessible from the outside of said casing.

22. The container as defined in claim 1, wherein said latch assembly further comprises one or more electrical batteries disposed within said internal cavity of said casing for providing an electrical power to said electronic control module.

23. A container, comprising:

a hollow body portion having a closed bottom and an open top;

a hinged lid member pivotally attached to said body portion so as to be selectively movable between an open position to access said container and a closed position to close said open top thereof and restrict access to said container;

a latch assembly fixed to one of said body portion and said lid member; and a locking strap having a first end portion fixed to another of said body portion and said lid member, and a second end portion disposed opposite to said first end portion and provided with an engagement member;

said latch assembly comprising:

a casing defining an internal cavity therein, said casing fixed to one of said body portion and said lid member;

a lock bolt reciprocating between a locked position preventing an opening of said lid member of said container and an unlocked position allowing the opening of said lid member, said lock bolt engaging said engagement member of said second end portion of said locking strap in said locked position, said lock bolt being disengaged from said engagement member of said second end portion of said locking strap in said unlocked position;

an actuator secured within said internal cavity of said casing for moving said lock bolt out of engagement with said engagement member;

one of a signal receiver for receiving a wireless signal and an accelerometer for monitoring acceleration of said container; and an electronic control module electrically connected to the one of said signal receiver and said accelerometer for controlling the operation of said actuator in response to one of said wireless signal and data from said accelerometer;

said latch assembly further comprises an arming member such that the movement of said arming member causes the movement of said lock bolt toward said locked position thereof; and wherein said arming member includes a knob integrally formed therewith and extending from said internal cavity of said casing for manually moving said arming member by a user.

24. The container as defined in claim 17, wherein said arming member reciprocates in the direction substantially perpendicular to the reciprocating direction of said lock bolt.

25. The container as defined in claim 17, wherein said arming member is pivotable relative to said casing.

* * * * *